US005623256A

United States Patent [19]

Marcoux

[11] Patent Number: 5,623,256

[45] Date of Patent: Apr. 22, 1997

[54] RADIO PAGING ELECTRICAL LOAD CONTROL SYSTEM AND DEVICE

[76] Inventor: Paul A. Marcoux, 34 Lincoln Ave., Central Falls, R.I. 02863

[21] Appl. No.: 356,665

[22] Filed: Dec. 15, 1994

[51] Int. Cl.[6] ..... G08C 19/00; H05B 37/00

[52] U.S. Cl. ..... 340/825.69; 340/825.47; 315/312; 362/233

[58] Field of Search ..... 340/825.69, 825.72, 340/825.44, 825.47, 825.06; 315/316, 312, 315; 362/233

[56] References Cited

U.S. PATENT DOCUMENTS

| | | | |
|---|---|---|---|
| 3,971,028 | 7/1976 | Funk | 343/225 |
| 4,037,201 | 7/1977 | Willmott | 340/167 |
| 4,095,139 | 6/1978 | Symonds et al. | 315/315 |
| 4,242,614 | 12/1980 | Vatis et al. | 315/153 |
| 4,305,060 | 12/1981 | Apple et al. | 340/825.65 |
| 4,590,471 | 5/1986 | Pieroway et al. | 340/825.69 |
| 4,656,475 | 4/1987 | Miller et al. | 340/825.06 |
| 4,686,380 | 8/1987 | Angott | 307/125 |
| 4,689,547 | 8/1987 | Rowen et al. | 323/239 |
| 4,716,344 | 12/1987 | Newell et al. | 315/312 |
| 4,755,792 | 7/1988 | Pezzolo et al. | 340/825.06 |
| 4,780,621 | 10/1988 | Bartleucci et al. | 307/11 |
| 4,794,371 | 12/1988 | Yamamoto | 340/825.64 |
| 4,843,386 | 6/1989 | Wolf | 340/825.69 |
| 5,382,947 | 1/1995 | Thaler et al. | 340/825.69 |

OTHER PUBLICATIONS

Gutzwiller, Control Networks for the home, Oct. 1993 pp. 109–112, Machine Design Magazine.

*Primary Examiner*—Michael Horabik
*Assistant Examiner*—Edward Merz
*Attorney, Agent, or Firm*—Russell & Russell

[57] ABSTRACT

A system for remote control of electrical load devices, particularly electrical lighting where the commands are broadcast over a radio pager system. A radio pager receiver is located within or nearby the electrical light fixture and is normally in a standby state, receives the commands broadcast. The radio pager receiver is connected to a computer processor and electronic circuitry. The computer processor interprets the commands and instructs the electronic circuitry to perform a desired operation. These operations include but are not limited to turning an electrical light element or group of electrical light elements on or off, dimming the light element or reprogramming the electrical light element to be included in a different control group of lights. In addition, before the operation is accomplished, the computer processor checks for the appropriate security code entry. In addition, there are protection mechanisms built into the computer processor so that if the decoding of the commands indicates that a large block of devices is to be turned on at the same time, the operation will be staggered so as to prevent a huge inrush of current and potential for tripping of the building's main electrical overcurrent device or circuit.

24 Claims, 9 Drawing Sheets

RADIO PAGING ELECTRICAL LOAD CONTROL SYSTEM

RADIO PAGING ELECTRICAL LOAD CONTROL SYSTEM

RADIO PAGING ELECTRICAL LOAD CONTROL DEVICE

RADIO PAGING ELECTRICAL LOAD CONTROL DEVICE

RADIO PAGING ELECTRICAL LOAD CONTROL DEVICE

RADIO PAGING ELECTRICAL LOAD CONTROL DEVICE REPROGRAMMING

RADIO PAGING ELECTRICAL LOAD CONTROL SYSTEM

RADIO PAGING ELECTRICAL LOAD CONTROL SYSTEM AND DEVICE

BACKGROUND OF THE INVENTION

The field of the present invention relates generally to the remote control of electrical apparatus and, more particularly, to an apparatus and method of using a radio paging network and radio pager receiver to transmit and receive remotely programmable digital command codes which will selectively control the state and intensity of remotely located electrical lights or other electrically powered devices, either individually or together in a preprogrammed set. When the radio paging electrical load control system is used to control lighting within an office building, for example, the user is allowed the flexibility of controlling the electrical lighting or other devices within an entire building, entire floors, a specific office light or any portion thereof or almost any combination of multiple individual devices or sub-unit devices on a floor within a building or any other area requiring remote control systems. In addition, the radio paging electrical load control system allows remote reprogramming of the number of electrical lights or devices to allow an almost infinitely variable combination of controllable sets of electrical lights or devices. The system also provides an infrared line-of-sight transmitter which allows for on-site manual override. In addition, a manual hardwired override capability can be included.

Attention is called to U.S. Pat. Nos.: 3,906,348; 3,971,028; 4,037,201; 4,242,614; 4,305,060; 4,590,471; 4,686,380; 4,689,547; 4,780,621; 4,794,371; 4,839,641; 4,843,386; 5,281,962; 5,291,192; and 5,337,044.

As energy costs increase, businesses, especially those located in large, high-rise office buildings, have looked for ways to increase energy savings and to lower electrical power bills. Electrical power companies, faced with shortages of electrical power, especially during peak loading times, often offer businesses incentives to quickly cut power consumption. Those incentives often involve cutting or reducing the use of electricity during peak periods as well as controlling demand loading by reducing lighting levels, staggering lighting energizing at business startup time and after a power outage.

Besides reducing electricity bills, flexibility in arranging lights in groupings that can be remotely programmed and controlled is desirable. The ability to quickly and remotely reprogram electrical light groupings in accordance with changing office needs is also desirable. In large office buildings there is a need to quickly and easily switch electrical light groupings according to the needs of different occupants or to accommodate changing needs of the same occupants.

In addition to the remote control capability, an on-site remote control or hardwired override capability for normal operation, reprogramming, testing or emergency situations is also needed.

Previous systems have relied on various methods of remotely controlling lights, with some systems sending a radio transmission using pulse width modulation or other non-digital transmission techniques to a radio receiver. Although generally reliable, these systems are expensive, both to manufacture and to install. In addition, they may be susceptible to noise and not include error detection capabilities.

For the foregoing reasons, there is a need for a system to remotely control electrical apparatus, particularly lights that is quick, easy to use, accurate, secure, low cost and reliable which provides the ability to remotely program and control a portion of an electrical light fixture or group of fixtures as well as manual on-site override capability.

SUMMARY OF THE INVENTION

The present invention is directed to a system, device and method of use that satisfies these needs. The present invention provides a system, device and method of use for the control of electrical apparatus, particularly lights that is quick, easy to use, accurate, secure, low cost and reliable which provides the ability to remotely program and control an electrical light fixture or group of fixtures as well as manual on-site override capability.

A radio paging electrical load controlling system having features of the present invention comprises a means of communicating with an existing radio paging network and a radio paging electrical load control device located within or nearby an electrical light fixture. Communication with the radio paging network may be made by accessing the radio paging network via a phone line. Commands are entered either by a computer and modem connected to the phone line or by an operator manually entering the commands via the phone itself. Once the required security and action command codes are received by the radio paging network, the network sends a signal containing the commands to a radio paging electrical load control device, located within or nearby an electrical light fixture or fixtures, which contains an individual radio paging receiver, which is left in a continuous standby mode. The radio paging electrical load control device also comprises a decoder, central processing unit (CPU), memory device and lighting control module. The decoder and processor recognize and decode the commands. An electronic circuit then performs the command that was transmitted. In addition, there are protection mechanisms built into the CPU program so that if the decoding of the command codes indicates that a large block of devices is to be turned on or off at the same time, it will stagger the operation so as to prevent a huge inrush of current and eliminate the potential for tripping of the building's main electrical overcurrent device or circuit. For those buildings, or locations within a building that prevent radio signal reception, the control device can be hardwired to a control mechanism, such as a traditional light switch, remote receiver or an infrared override can be used.

Current network pager technology can be used because it is adequate to transmit the desired command control codes and is presently reliable and low cost. The present invention can be easily changed in the future to adapt to any significant advances in paging technology such as alpha numeric, digital voice or increased bandwidth simply by changing the command code structure.

In the present method, a radio pager network is accessed by a telephone and commands are transmitted to the existing radio pager network. The entry can be done manually by a person entering the codes or by a computer which is preprogrammed to enter the codes automatically or when the program is actuated by a user or by voice control. At the present time, this invention makes use of a radio pager network capable of transmitting up to 26 digits. Therefore, at the present time, the command control codes use up to 26 digits which provide for an almost infinite number of possibilities with regard to command control codes in the future, expansion of digits and alphanumeric commands can be added to the system to allow for future expansion of the command code format.

After accessing the paging network, the security code is entered and verified upon reception by the radio paging electrical load control device. The security code may be followed by a command code. The command code provides the data necessary to locate a particular building, floor and electrical light fixture or group of electrical light fixtures, the number of ballasts to be controlled per device and can also contain a reprogramming code. The command code format contains a primary group load code, a secondary group load code, a unit circuit code, a unit load code, a sub-unit load code, a load action code and/or a reprogramming code. The primary group load code indicates the particular building and all lighting fixtures therein; the secondary group load code indicates the floor and all lighting fixtures thereon; the unit circuit code indicates the particular portion of the device(s) to be controlled on a floor; and the unit load code indicates the individual lighting fixture and the sub-unit load code indicates the number of fluorescent lighting ballasts to be controlled per unit. The load action code indicates whether the device or group of devices is to be turned on or off or to some variable level. The reprogramming code indicates that a reprogramming of a device or group of devices is about to be accomplished.

If a reprogramming operation is desired, that is, a reprogramming of the electrical light fixtures to be grouped together so as to be able to be controlled together, once the radio pager receiver within the electrical light fixture receives the correct security and reprogramming code, the radio pager electrical load control device will begin the reprogramming operation. The reprogramming operation involves identifying the current device or group of devices and transmitting a new code to reprogram the current device or group of devices. The reprogramming commands are transmitted to the processor and the memory is changed. A non-volatile, electrically erasable programmable read only memory (EEPROM) is used in the present invention, but other types of reprogrammable memory now known or available in the future may be used. Should a power interruption occur, the non-volatile memory saves the last set of conditions so that when power is eventually returned, lighting will be reinitialized to the pre-power outage state.

The present invention also provides for an infrared remote control load override and reprogramming capability. This can be used for normal operation and reprogramming, and for initially grouping devices and testing those groups and individual devices or can be used in case of emergency to override the system. In addition, the control of the radio paging electrical load control device can be hardwired to provide for manual switch control.

BRIEF DESCRIPTION OF THE DRAWINGS

These and other features, aspects, and advantages of the present invention will become better understood with regard to the following description, appended claims, and accompanying drawings where:

FIG. 6 (*a*) is a normal operation command code format; FIG. 6 (*b*) is a reprogramming operation command code format; and FIG. 6(*c*) is a security command code format.

DETAILED DESCRIPTION

Figure 1:
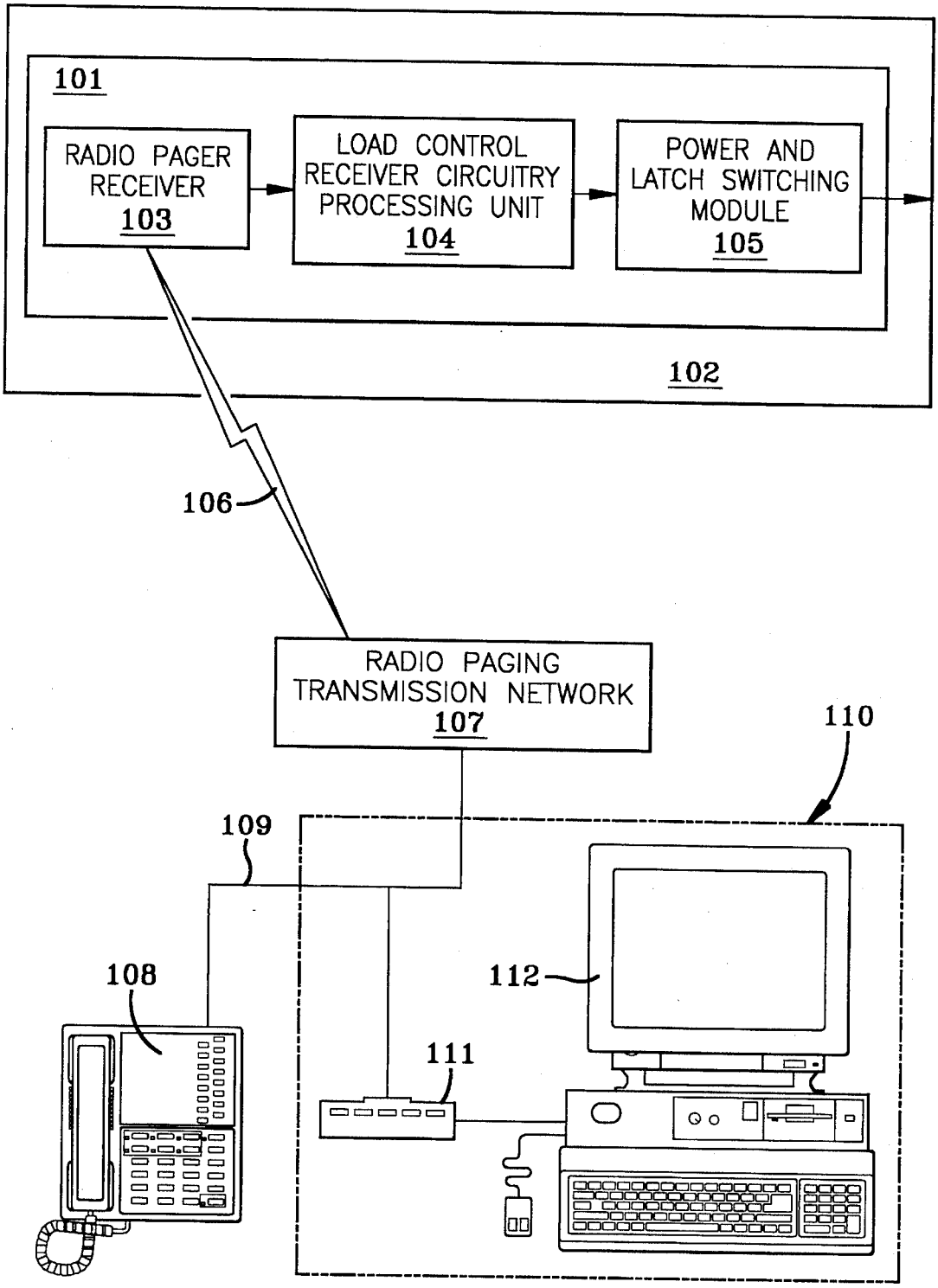
FIG. 1 shows a system diagram of a radio paging electrical load control system and a radio paging electrical load control device in accordance with a preferred embodiment of the present invention.

Turning now to FIG. 1, a preferred embodiment of the radio paging electrical load control system, is shown in accordance with the present inventive concept. In FIG. 1, a computer 112 is shown connected to a modem 111, which is in turn connected to a telephone network 109. The computer 112 provides a means of communicating with the radio paging network 107 via a telephone network 109. Alternately, a telephone 108 can be connected to the telephone network 109 to provide direct entry by a person of commands to be transmitted to the radio paging network 107. The paging network 107 sends the commands via a signal 106 entered via the computer 112 or the telephone 108 to the radio paging electrical load control device 101 which contains a radio pager receiver 103. The radio pager receiver 103 is located within an electrical lighting unit 102. The electrical lighting unit 102 also contains load control receiver circuitry processing unit 104 which is in turn connected to a power latch and switching module 105.

Figure 2:
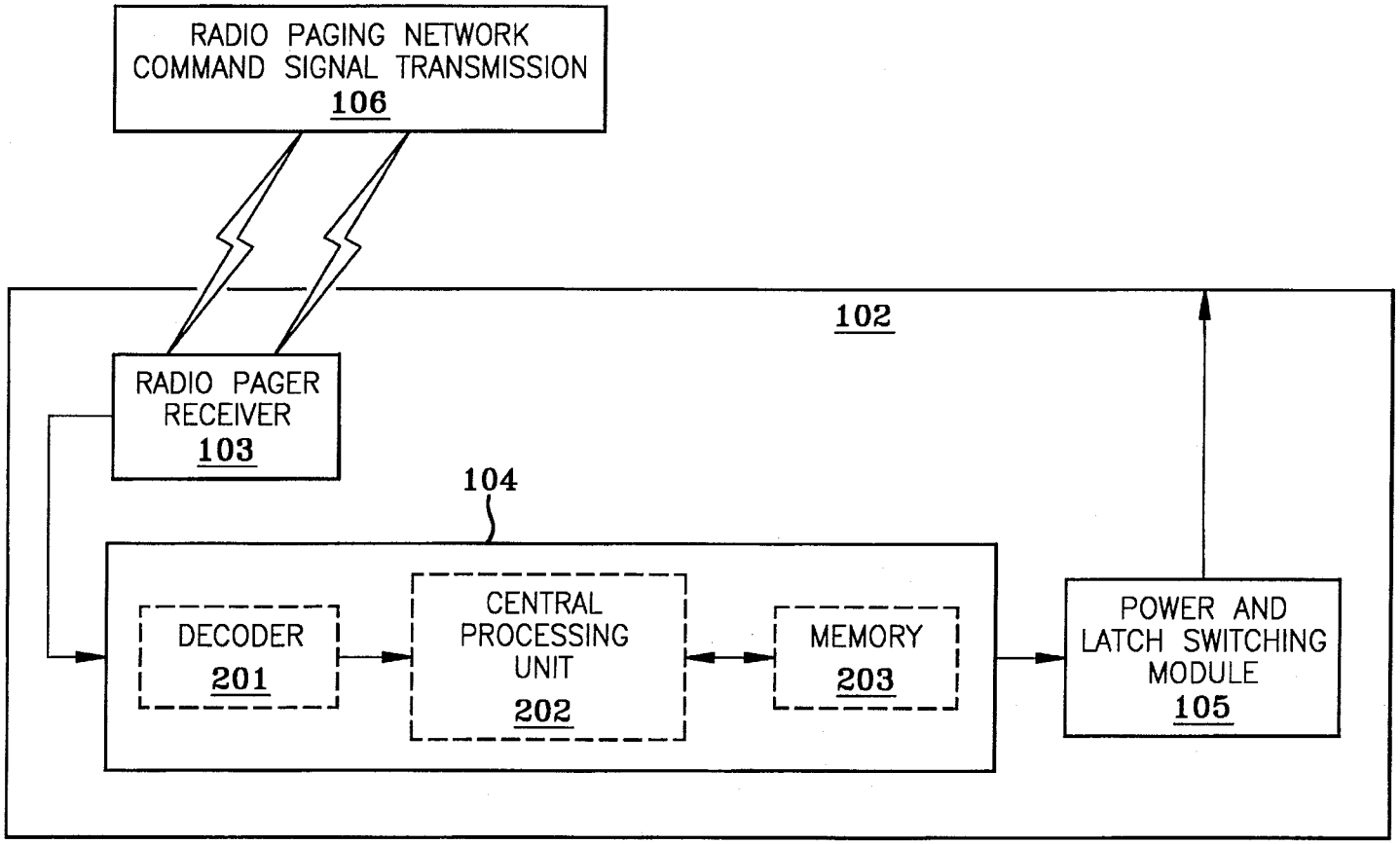
FIG. 2 is a block diagram of a radio paging electrical load control device.

Turning now to FIG. 2, a block diagram of the radio paging electrical load control device 101 of FIG. 1 is shown in accordance with present inventive concepts. The pager receiver 103 receives the command signal 106 from a remote location and forwards it to the load control receiver circuitry processing unit 104 which contains a decoder 201 which decodes the command signal 106, forwards it to the central processing unit (CPU) 202 which compares and interprets the decoded command to data stored in memory 203. Once the load control receiver circuitry processing unit 104 has completed its processing of the received command signal 106, it forwards the results to the power latch and switching module 105.

Figure 3:
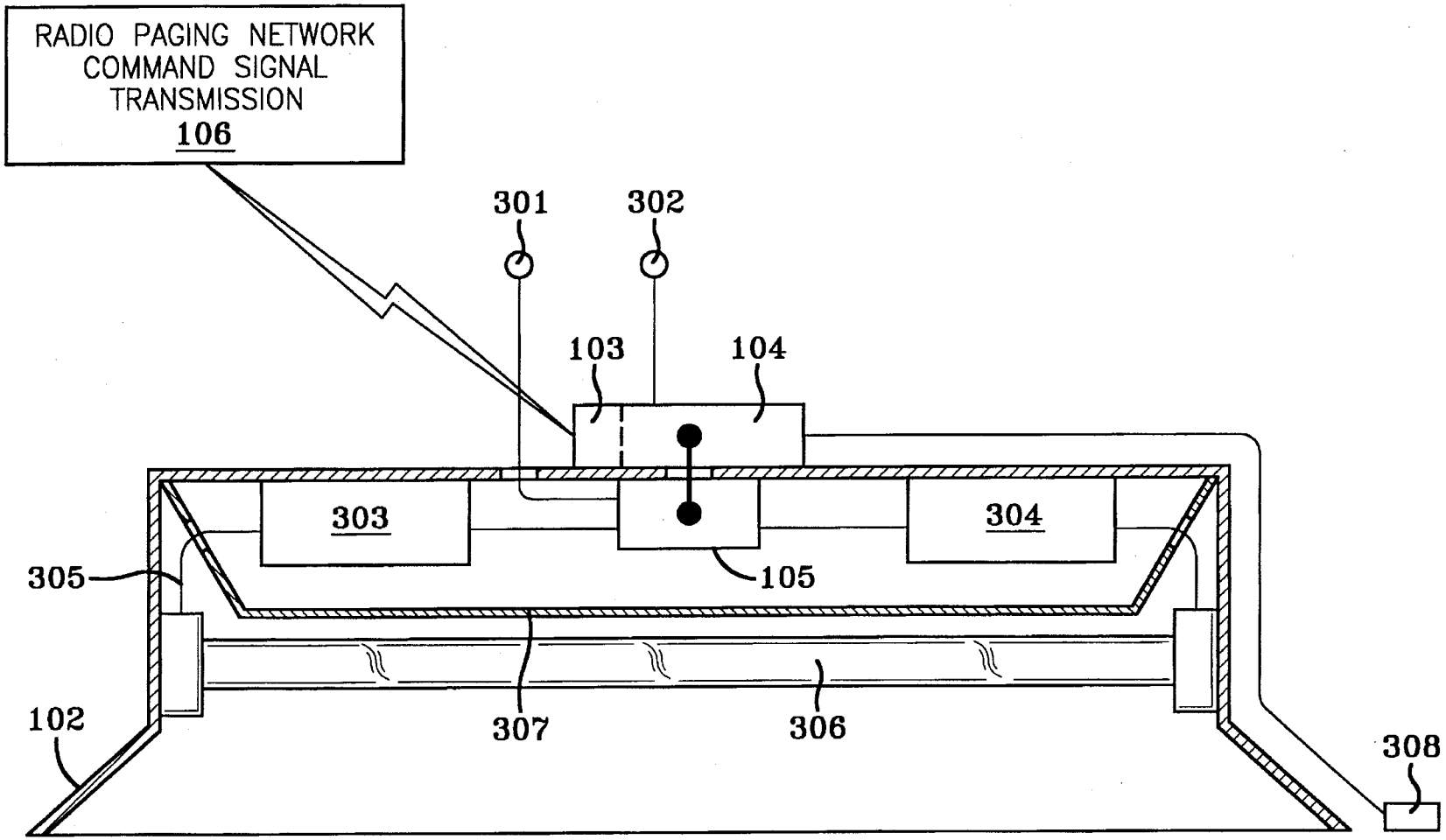
FIG. 3 is a side view of the radio paging electrical load control device as installed in a typical fluorescent light fixture in accordance with a preferred embodiment of the present invention.

Turning now to FIG. 3, a side view of a preferred embodiment of the radio paging electrical load control device 101 of FIG. 1 as installed in a typical fluorescent light fixture 102 is shown in accordance with present inventive concepts. The radio pager receiver 103 is installed external to the light fixture 102 and reflector 307 to receive the command signal 106 from a remote location and is connected to the power and latch switching module 105 which is in turn connected to the fluorescent lamp ballasts 303 and 304. Primary input power 301 is also connected to the power and latch switching module 105 and is also the power source for the radio paging electrical load control device 101. A local infrared receiving sensor 308 is connected to the load control receiver circuitry processing unit 104 to provide for local control of the lamp fixture 102.

Figure 4:
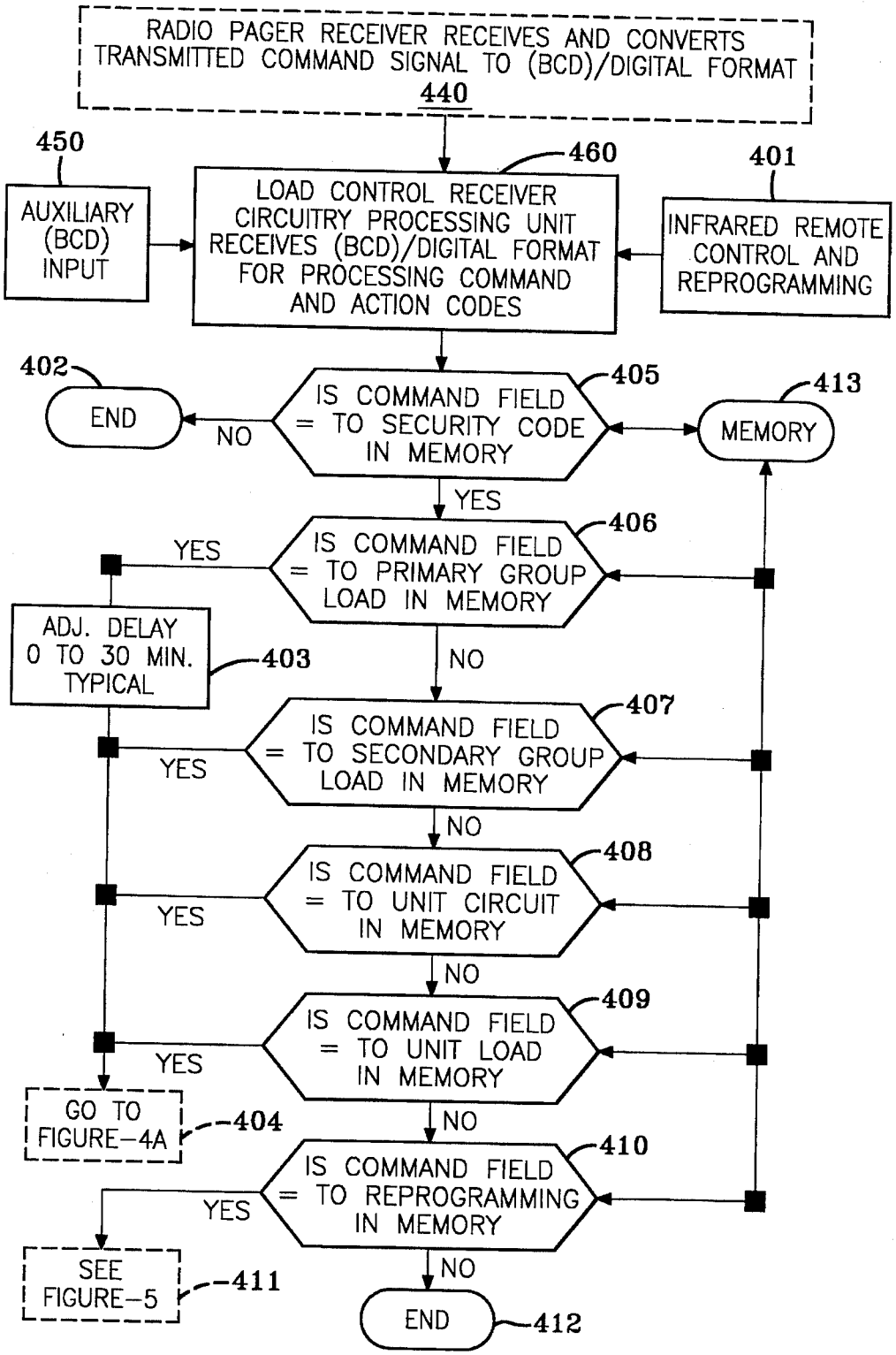
FIGS. 4 and 4A are flow charts illustrating the radio paging electrical load control system and device command operational sequence during normal operation in accordance with a preferred embodiment of the present invention.
Figure 4A:
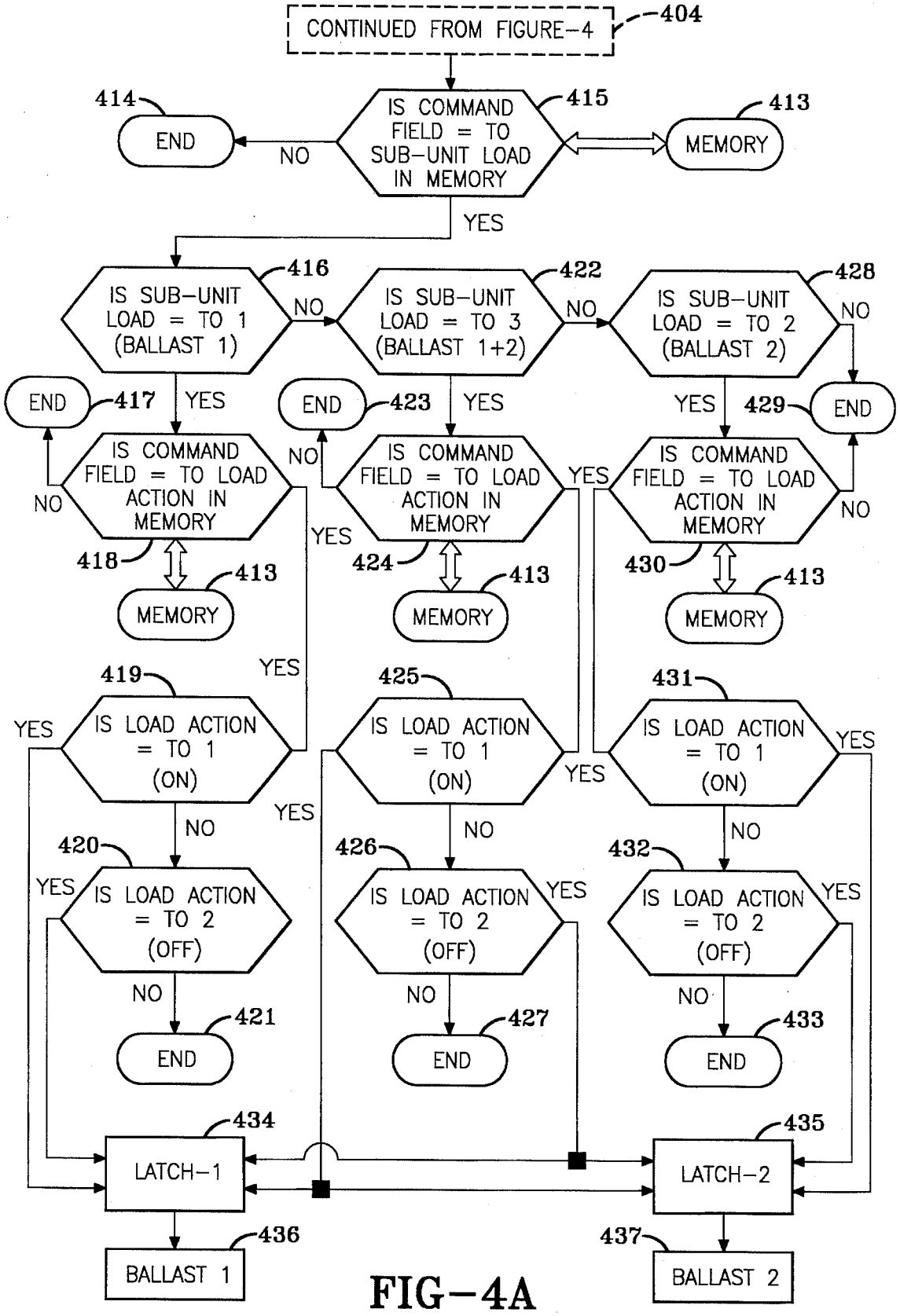

FIG. 4 is a flowchart describing the normal operation of a preferred embodiment of the radio paging load control system, in accordance with the present inventive concepts. At step 440, the radio paging network command signal transmission is received by the radio pager receiver and converted to Binary Coded Decimal (BCD) digital format. Alternatively, the command signal can be locally transmitted by infrared remote control step 401 or by auxiliary Binary Coded Decimal (BCD) input step 450. In all cases, the load control receiver circuitry processing unit receives the BCD digital format step 460. If the command field is not the correct security code step 405, processing ends step 402. If the command field is the correct security code step 405, the command fields are checked steps 406, 407, 408, 409, and 410 by accessing memory steps 413 to determine the command code action to be taken. If no command action code matches with memory, processing ends step 412. If the command field indicates a reprogramming action 410, the reprogramming operation is entered 411 and is described in FIG. 5. Otherwise, if the command field matches memory, the adjustable delay action step 403 is enacted and processing continues step 404. The sub-unit load code is checked step 415. If it does not match memory step 413, processing ends step 414. If it does match memory step 413, the sub-unit load code value is checked steps 416, 422, and 428 to determine whether ballast 1 step 416, ballasts 1 and 2 step 422 or ballast 2 step 428 are to be controlled. If no ballast or combination of ballasts is indicated, processing ends step 429. The command load action code steps 418, 424, and 430 matches memory step 413, the load action code is checked to determine whether the operation indicated is on or off steps 419, 425, 431, 420, 426, 432. If the command load action code steps 418, 424, 430 does not match memory step 413, the load action does not indicate an on or off action steps 419, 425, 431, 420, 426, and 432 and processing ends steps 417, 423, 429, 421, 427 and 433. Otherwise, the ballasts steps 436 and 437 are turned on or off by the latch mechanisms steps 434 and 435.

Figure 5:
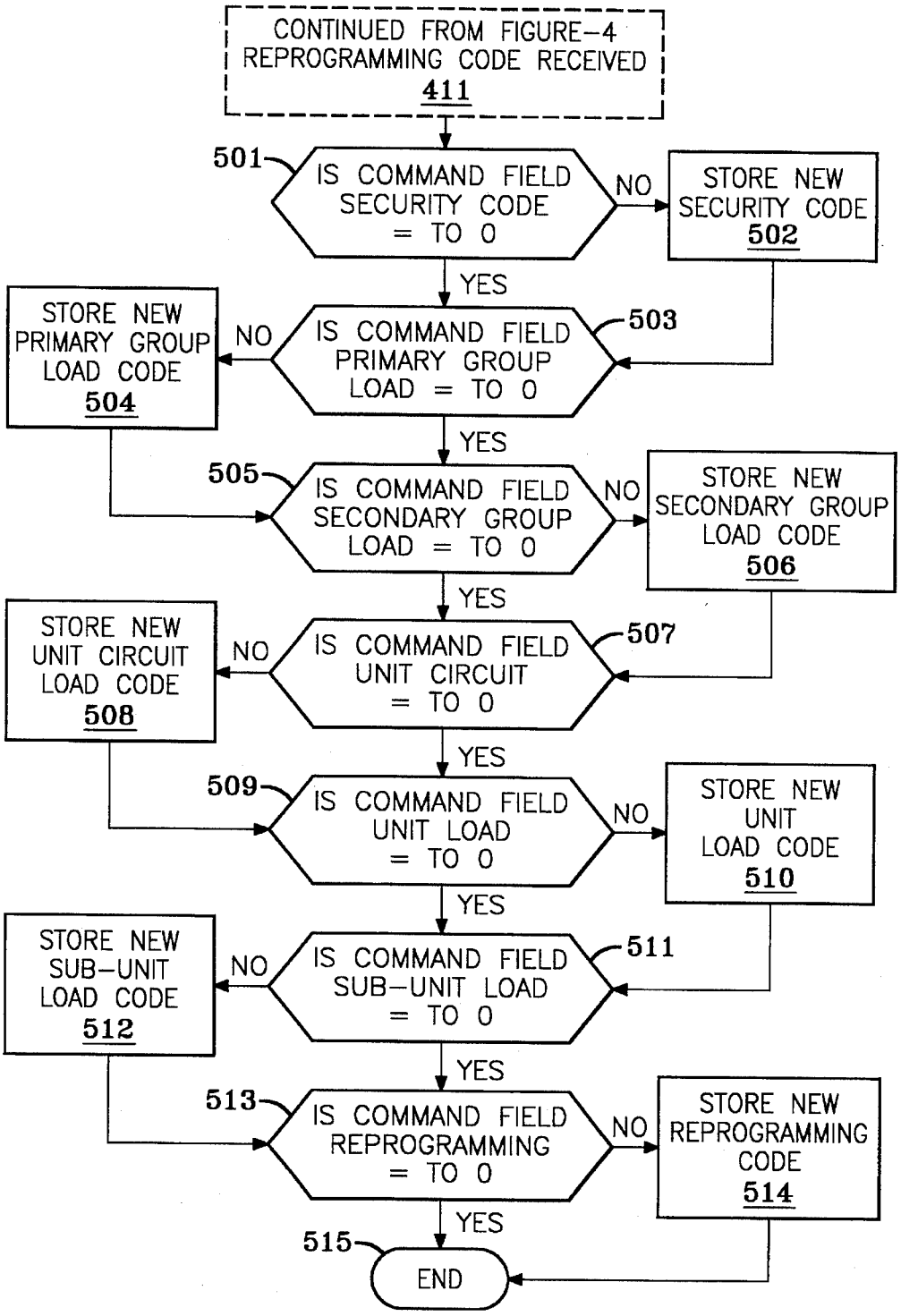
FIG. 5 is a flow chart illustrating the radio paging electrical load control system and device command operational sequence during reprogramming operation in accordance with a preferred embodiment of the present invention.

Turning now to FIG. 5, a flowchart describing the reprogramming operation of a preferred embodiment of the radio paging load control system is shown, in accordance with the present inventive concepts. The radio paging electrical load control device receives the signal command from the radio pager step 411. If the security code is not equal to zero step 501, the new security code is stored step 502. If the command field primary group code is not equal to zero step 503, the new primary group load code is stored in memory step 504. If the command field secondary group load code is not equal to zero step 505, the new secondary group code is stored in memory step 506. If the command field unit circuit code is not equal to zero step 507, the new unit circuit code is stored in memory 508. If the command field load action code is not equal to zero step 509, the new load action code is stored in memory step 510. If the command field sub-unit load code is not equal to zero step 511, the new sub-unit load code is stored step 512. If the command reprogramming field is not equal to zero step 513, the new reprogramming code is stored step 514. Processing ends step 515.

Figure 6A:
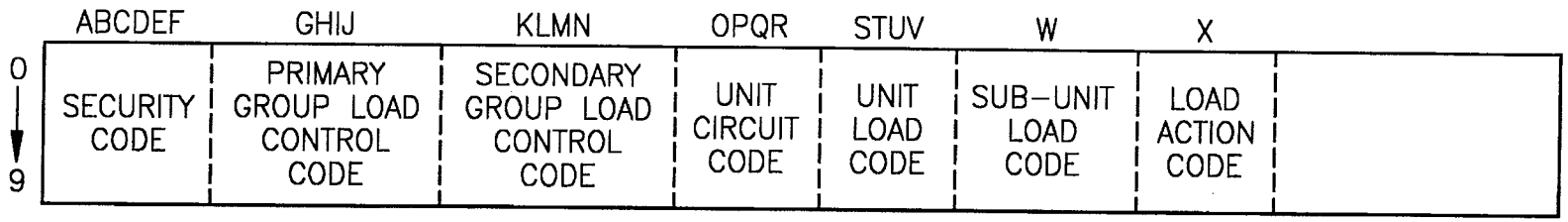
FIGS. 6(*a*) through 6(*c*) are diagrams illustrating specific command code formats of the radio paging electrical load control system in accordance with a preferred embodiment of the present invention.
Figure 6B:
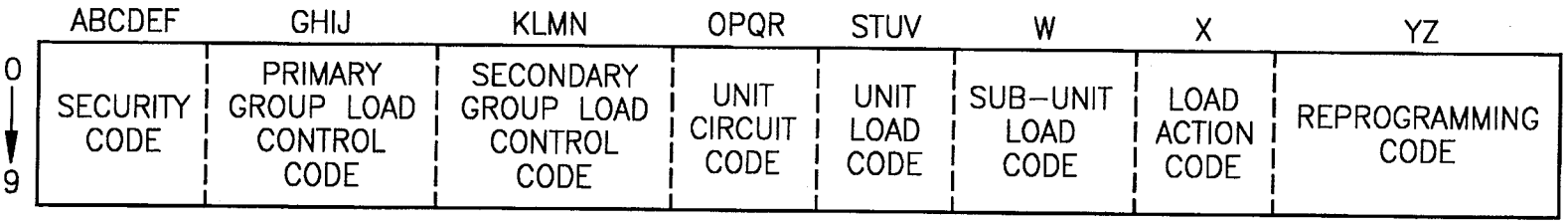
Figure 6C:
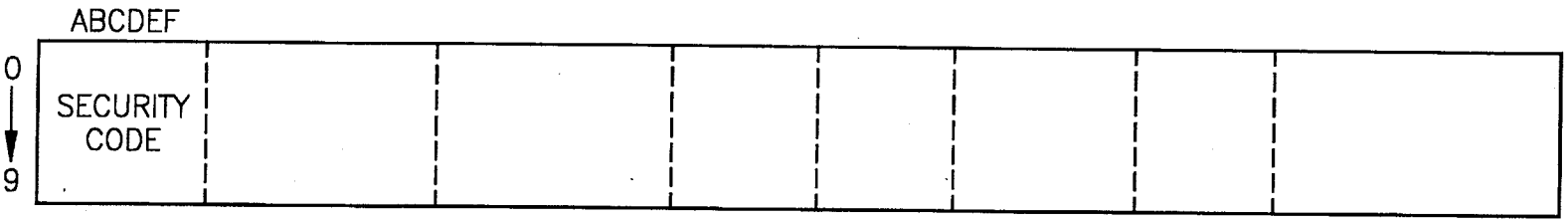

Turning now to FIG. 6, an example of a specific command code formats of a preferred embodiment of the radio paging load control system is shown, in accordance with present inventive concepts. FIG. 6 (*a*) shows an example of a normal operation command code format. FIG. 6 (*b*) shows an example of a reprogramming operation command code format. FIG. 6 (*c*) shows an example of the security command code format.

Figure 7:
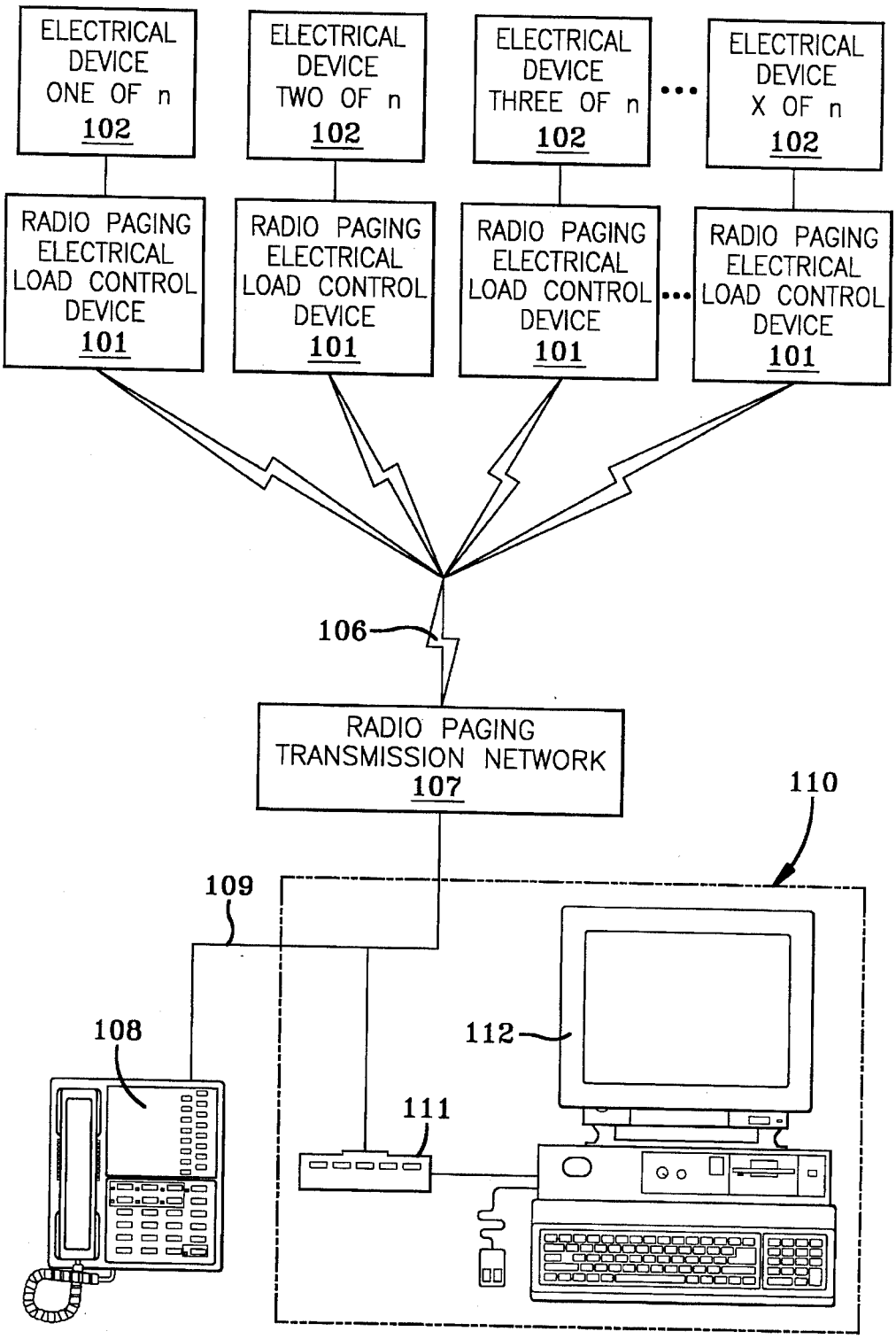
FIG. 7 is a system diagram of a radio paging electrical load control system which shows the radio paging transmission network communicating with a number of radio paging electrical load control devices which are connected to electrical load control devices.

Turning now to FIG. 7, a system diagram of a preferred embodiment of the radio paging electrical load control system is shown in accordance with the present inventive concept. In FIG. 7, the paging network 107 sends a command signal transmission 106 entered via the computer 112 and modem 111 or the telephone 108 and are transmitted over the telephone network 109 to the radio paging transmission network 107. The paging network 107 sends the command to a plurality of radio paging electrical load control devices 101, each of which is connected to an electrical device 102.

Figure 8:
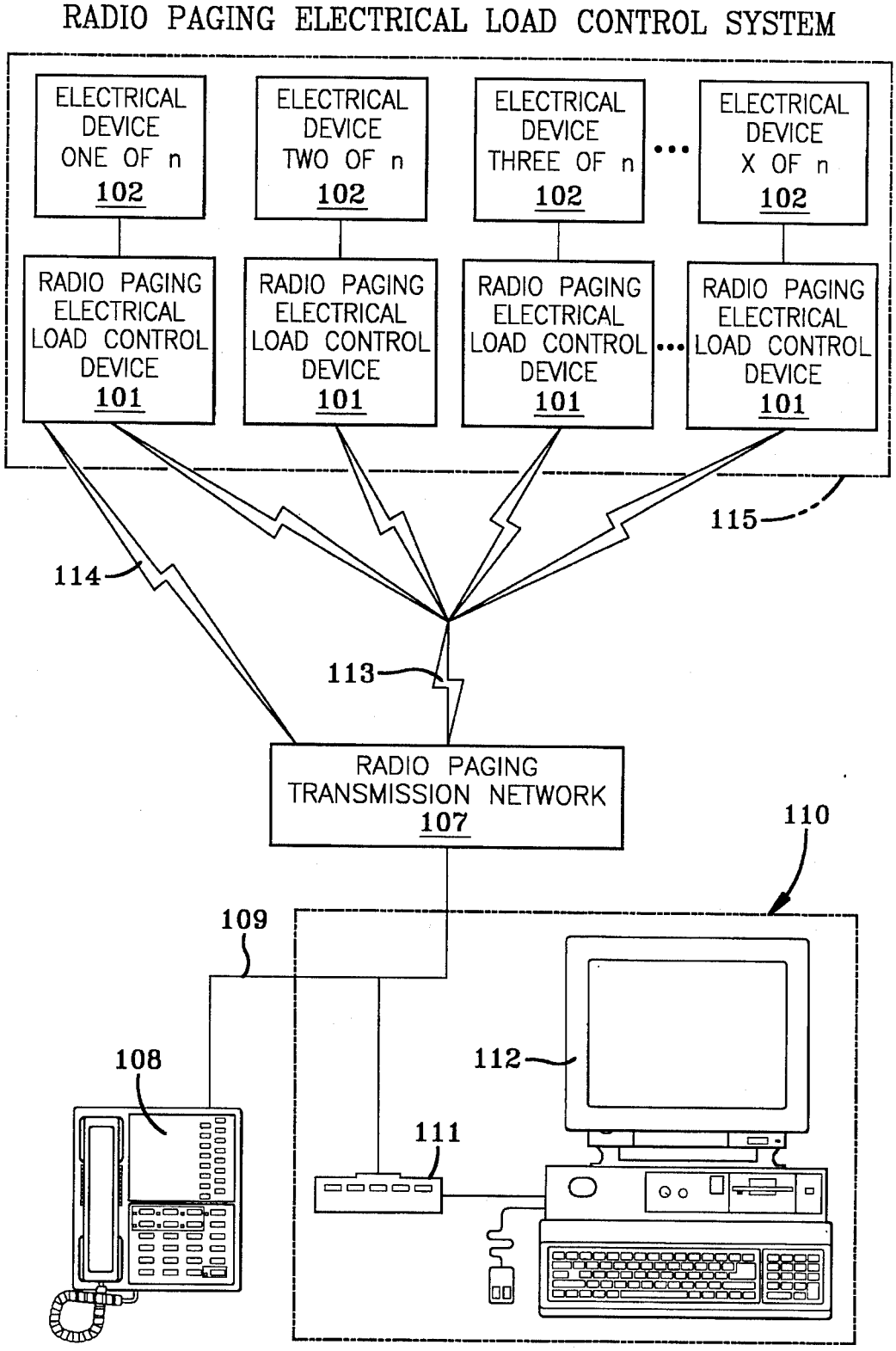
FIG. 8 is a system diagram of a radio paging electrical load control system which shows the radio paging transmission network communicating with radio paging electrical load control devices as a group, yet still being able to individually control the state of a device while it is part of the group.

Turning now to FIG. 8, a system diagram of a preferred embodiment of the radio paging electrical load control system is shown in accordance with the present inventive concept. In FIG. 8, the electrical devices 102 are grouped together to form a group of devices 115. Commands are entered via a computer 112 and modem 111 or the telephone 108 and are transmitted over the telephone network 109 to the radio paging transmission network 107. The paging network 107 sends one group command signal transmission 113, which is received by all radio paging electrical load control devices 101 in the device group 115. Alternatively, the paging network 107 sends a unit command signal transmission 114 to an individual radio paging electrical load control device 101 to control the state of a single device 102, even while the device is part of the larger electrical device group 115. The number of electrical device groups 115 is shown as n, since there can be any number of electrical device groups.

What is claimed is:

1. A radio paging electrical load control device, connected to and located within or nearby an electrical light fixture for controlling the operational state of an electrical light fixture or groups of fixtures, comprising:

a. a receiving mechanism located within or nearby an electrical light fixture for accepting coded digital commands;

b. a processing mechanism connected to the receiving mechanism for decoding received commands;

c. a lighting control mechanism connected to the processing mechanism and to the lighting unit for accepting the decoded command and performing the command operation on the electrical light or device;

d. a power supply connected to the receiving, processing and lighting control mechanisms;

e. the digital commands received by the receiving mechanism and processed by the processing mechanism can remotely control the operational state of a single electrical light fixture;

f. the digital commands received by the receiving mechanism and processed by the processing mechanism can remotely program and reprogram the electrical light fixtures into groups;

g. the digital commands received by the receiving mechanism and processed by the processing mechanism can remotely control the operational state of a group of electrical light fixtures with one command while still being able to individually control the state of any single light fixture even while the fixture is part of the larger group of electrical light fixtures; and h. said control of the operational state of a light fixture, a group of light fixtures and light fixtures within a group, and remote programming and reprogramming of the electrical light fixtures into groups is independent of signal and power connections.

2. A radio paging electrical load control device connected to and located within or nearby an electrical light fixture for controlling the operational state of the electrical light fixture or groups of fixtures, according to claim 1, further comprising, a second receiving mechanism located within or nearby an electrical light fixture connected to the processing mechanism for accepting commands from an infrared remote control device or manual switch device.

3. A radio paging electrical load control device connected to and located within or nearby an electrical light fixture for controlling the operational state of the electrical light fixture or groups of fixtures, according to claim 1, further comprising, a second receiving mechanism located within or nearby an electrical light fixture connected to the processing mechanism for accepting command input from a hardwired switch device.

4. A radio paging electrical load control device connected to and located within or nearby an electrical light fixture for controlling the operational state of the electrical light fixture or groups of fixtures, according to claim 2, further comprising, an additional receiving mechanism located within or nearby an electrical light fixture connected to the processing mechanism for accepting command input from a hardwired switch device.

5. A radio paging electrical load control device connected to and located within or nearby an electrical light fixture for controlling the operational state of the electrical light fixture or groups of fixtures, according to claim 1, wherein the processing mechanism comprises:

a. a decoder for decoding the received commands;

b. a non-volatile memory device for storing security, reprogramming, operational state data and unit and group data;

c. a central processing unit for comparing the decoded commands to the data stored in the memory device and storing new data for reprogramming in the memory device;

d. the security, reprogramming, operational state data and unit and group data remains stored in the non-volatile memory device until new data is received; and e. the stored operational data is used to reenergize the state of the fixture or group of fixtures after a power interruption to the same operational state as prior to the power interruption.

6. A radio paging electrical load control device connected to and located within or nearby an electrical light fixture and for remotely controlling the operational state of the electrical light fixture or groups of fixtures, according to claim 5, wherein the processing unit further comprises the capability of momentarily delaying the control and staggering the operation of the electrical lighting fixture or control group so as to prevent a huge inrush of current and potential for tripping of the building's main electrical overcurrent device or circuit.

7. A radio paging electrical load control device connected to and located within or nearby an electrical light fixture for controlling the operational state of the electrical light fixture or groups of fixtures, according to claim 1 wherein the processing mechanism further comprises the capability of remotely programming and reprogramming the light fixture control group and unit.

8. A radio paging electrical load control device connected to and located within or nearby an electrical light fixture for controlling the operational state of the electrical light fixture or groups of fixtures, according to claim 1, wherein the processing mechanism further comprises the capability of remotely programming and reprogramming and storing a new security code.

9. A radio paging electrical load control device connected to and located within or nearby an electrical light fixture for controlling the operational state of the electrical light fixture or groups of fixtures, according to claim 1, wherein the remote control of the operational state of an electric light fixture or group of electric light fixtures is set to the state specified in the digital input command and overrides the current state of the light fixture, even if the light fixture is physically set to off by a manual switch.

10. A radio paging electrical load control device connected to and located within or nearby an electrical light fixture for controlling the operational state of the electrical light fixture or groups of fixtures, according to claim 1, further comprising the capability of the digital commands received by the receiving mechanism and processed by the processing mechanism to remotely control the light level of the electrical light fixture or groups of fixtures.

11. A radio paging electrical load control device connected to and located within or nearby an electrical light fixture for controlling the operational state of the electrical light fixture or groups of fixtures, according to claim 1, wherein the digital commands received by the receiving mechanism and processed by the processing mechanism are alphanumeric paging commands.

12. A radio paging electrical load control device connected to and located within or nearby an electrical light fixture for controlling the operational state of the electrical light fixture or groups of fixtures, according to claim 1, wherein the digital commands received by the receiving mechanism and processed by the processing mechanism are binary coded decimal paging commands.

13. A radio paging electrical load control device connected to and located within or nearby an electrical light fixture for controlling the operational state of the electrical light fixture or groups of fixtures, according to claim 1, further comprising, the capability of reenergizing the state of the electrical light fixture or group of fixtures after a power interruption to the same operational state as prior to the power interruption.

14. A radio paging electrical load control device connected to and located within or nearby an electrical light fixture for controlling the operational state of the electrical light fixture or groups of fixtures, according to claim 13, wherein the prior state is saved in a non-volatile memory device.

15. A radio paging electrical load control system using a paging network and paging receiver for controlling the operational state of an electrical light fixture or groups of fixtures, comprising:

a. a means of sending commands to a radio paging network;

b. a receiving mechanism located within or nearby an electrical light fixture for accepting commands from the radio paging network;

c. a processing unit connected to the receiving mechanism for decoding the received commands;

d. a lighting controller circuit connected to the processing unit for accepting the decoded command and performing the command operation on the electrical light or device;

e. the digital commands received by the receiving mechanism and processed by the processing mechanism can remotely control the operational state of a single electrical light fixture;

f. the digital commands received by the receiving mechanism and processed by the processing mechanism can remotely program and reprogram the electrical light fixtures into groups;

g. the digital commands received by the receiving mechanism and processed by the processing mechanism can remotely control the operational state of a group of electrical light fixtures with one command while still being able to individually control the state of any single light fixture even while the fixture is part of the larger group of electrical light fixtures; and h. said control of the operational state of a light fixtures, a group of light fixtures and light fixtures within a group, and remote programming and reprogramming of the electrical light fixtures into groups is independent of signal and power connections.

16. A radio paging electrical load control system using a paging network and paging receiver for controlling the operational state of an electrical light fixture or control group of fixtures, according to claim 15, further comprising, a second receiving mechanism located within or nearby an electrical light fixture connected to the processing unit for accepting commands from an infrared remote control.

17. A radio paging electrical load control system using a paging network and paging receiver for controlling the operational state of an electrical light fixture or control group of fixtures, according to claim 15, further comprising, a second receiving mechanism located within or nearby an electrical light fixture connected to the processing unit for accepting commands from a hardwired switch.

18. A radio paging electrical load control system using a paging network and paging receiver for controlling the operational state of an electrical light fixture or control group of fixtures, according to claim 16, further comprising, an additional receiving mechanism located within or nearby an electrical light fixture connected to the processing unit for accepting commands from a hardwired switch.

19. A method of using a radio paging electrical load control system for controlling the operational state of the electrical light fixture or groups of fixtures, comprising:

a. sending electrical light fixture control commands;

b. receiving electrical light fixture control commands;

c. decoding the received control commands using a processing unit connected to the receiving means;

d. using a lighting controller circuit for accepting the decoded command and performing the controlling operation on the electrical light;

e. the digital commands received by the receiving mechanism and processed by the processing mechanism can remotely control the operational state of a single electrical light fixture;

f. the digital commands received by the receiving mechanism and processed by the processing mechanism can remotely program and reprogram the electrical light fixtures into groups;

g. the digital commands received by the receiving mechanism and processed by the processing mechanism can remotely control the operational state of a group of electrical light fixtures with one command while still being able to individually control the state of any single light fixture even while the fixture is part of the larger group of electrical light fixtures; and h. said control of the operational state of a light fixture, a group of light fixtures and light fixtures within a group, and remote programming and reprogramming of the electrical light fixtures into groups is independent of signal and power connections.

20. A method of using a radio paging electrical load control system for controlling the operational state of an electrical light fixture or control group of fixtures, according to claim 19, wherein:

a. the sending of commands is via a radio paging network; and b. the receiving of commands is via a pager receiver located within or nearby an electrical light fixture.

21. A method of using a radio paging electrical load control system for controlling the operational state of an electrical light fixture or control group of fixtures, according to claim 19, wherein:

a. the sending of commands is via an infrared device; and b. the receiving of commands is via an infrared receiver located within or nearby an electrical light fixture.

22. A method of using a radio paging electrical load control system for controlling the operational state of an electrical light fixture or control group of fixtures, according to claim 19, wherein:

a. the sending of commands is via a device hardwired to the electrical light fixture or control group of fixtures; and b. the receiving of commands is via a device located within or nearby an electrical light fixture.

23. A method of using a radio paging electrical load control system for controlling the operational state of the electrical light fixture or groups of fixtures, according to claim 19 further comprising reenergizing the state of the electrical light fixture or group of fixtures after a power interruption to the same operational state as prior to the power interruption.

24. A radio paging electrical load control device, connected to and located within or nearby an electrical device for controlling the operational state of an electrical device or group of electrical devices, comprising:

a. a receiving mechanism located Within or nearby an electrical device for accepting coded digital commands;

b. a processing mechanism connected to the receiving mechanism for decoding received commands;

c. a control mechanism connected to the processing mechanism and to the electrical device for accepting the decoded command and performing the command operation on the electrical device;

d. a power supply connected to the receiving, processing and control mechanisms;

e. the digital commands received by the receiving mechanism and processed by the processing mechanism can remotely control the operational state of a single electrical device;

f. the digital commands received by the receiving mechanism and processed by the processing mechanism can remotely program and reprogram the electrical devices into groups;

g. the digital commands received by the receiving mechanism and processed by the processing mechanism can remotely control the operational state of a group of electrical devices with one command while still being able to individually control the state of any single device even while the device is part of the larger group of electrical devices; and h. said control of the operational state of a device, a group of devices and a device within a group, and remote programming and reprogramming of the electrical devices into groups is independent of signal and power connections.

* * * * *